US011325374B2

(12) United States Patent
Linn et al.

(10) Patent No.: US 11,325,374 B2
(45) Date of Patent: May 10, 2022

(54) SIGNAL MONITOR

(71) Applicant: HEWLETT-PACKARD DEVELOPMENT COMPANY, L.P., Spring, TX (US)

(72) Inventors: Scott A. Linn, Corvallis, OR (US); James M. Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/957,520

(22) PCT Filed: Feb. 6, 2019

(86) PCT No.: PCT/US2019/016745
§ 371 (c)(1),
(2) Date: Jun. 24, 2020

(87) PCT Pub. No.: WO2020/162902
PCT Pub. Date: Aug. 13, 2020

(65) Prior Publication Data

US 2021/0162745 A1 Jun. 3, 2021

(51) Int. Cl.
*B41J 2/045* (2006.01)
*B41J 29/38* (2006.01)

(52) U.S. Cl.
CPC ..... *B41J 2/04573* (2013.01); *B41J 2/04543* (2013.01); *B41J 2/04586* (2013.01); *B41J 29/38* (2013.01)

(58) Field of Classification Search
CPC . B41J 2/04573; B41J 2/04543; B41J 2/04586
See application file for complete search history.

(56) References Cited

U.S. PATENT DOCUMENTS

| | | | | |
|---|---|---|---|---|
| 6,286,922 | B1 * | 9/2001 | Kondou | B41J 2/04541 310/316.01 |
| 7,669,950 | B2 | 3/2010 | Silverbrook et al. | |
| 8,061,820 | B2 | 11/2011 | Ottosson et al. | |
| 8,684,980 | B2 | 4/2014 | Hunter et al. | |
| 8,974,030 | B2 | 3/2015 | Suzuki et al. | |
| 2010/0171777 | A1 | 7/2010 | Han | |
| 2011/0273507 | A1 * | 11/2011 | Yamato | B41J 2/0458 347/19 |
| 2012/0218334 | A1 | 8/2012 | Bergstedt | |
| 2019/0009527 | A1 | 1/2019 | Yamada | |

FOREIGN PATENT DOCUMENTS

| | | |
|---|---|---|
| EP | 0899102 A2 | 3/1999 |
| JP | 2010214803 | 9/2010 |

* cited by examiner

*Primary Examiner* — Thinh H Nguyen
(74) *Attorney, Agent, or Firm* — Dicke Billig & Czaja, PLLC

(57) ABSTRACT

An integrated circuit is disclosed. The integrated circuit includes an actuator to eject a fluid in response to a fire signal. The integrated circuit also includes a monitor circuit set by the fire signal to block the fire signal to the actuator circuit after a selected duration.

20 Claims, 2 Drawing Sheets

SIGNAL MONITOR

CROSS-REFERENCE TO RELATED APPLICATIONS

This application is a U.S. National Stage Application of PCT Application No. PCT/US2019/016745, filed Feb. 6, 2019, entitled "SIGNAL MONITOR".

BACKGROUND

Printing devices can include printers, copiers, fax machines, multifunction devices including additional scanning, copying, and finishing functions, all-in-one devices, or other devices such as pad printers to print images on three dimensional objects and three-dimensional printers (additive manufacturing devices). In general, printing devices apply a print substance often in a subtractive color space or black to a medium via a device component generally referred to as a printhead. Printheads can employ fluid actuator devices, or simply actuator devices, to selectively eject droplets of print substance onto a medium during printing. For example, actuator devices can be used in inkjet type printing devices. A medium can include various types of print media, such as plain paper, photo paper, polymeric substrates and can include any suitable object or materials to which a print substance from a printing device are applied including materials, such as powdered build materials, for forming three-dimensional articles. Print substances, such as printing agents, marking agents, and colorants, can include toner, liquid inks, or other suitable marking material that in some examples may be mixed with other print substances such as fusing agents, detailing agents, or other materials and can be applied to the medium.

DETAILED DESCRIPTION

Figure 1:
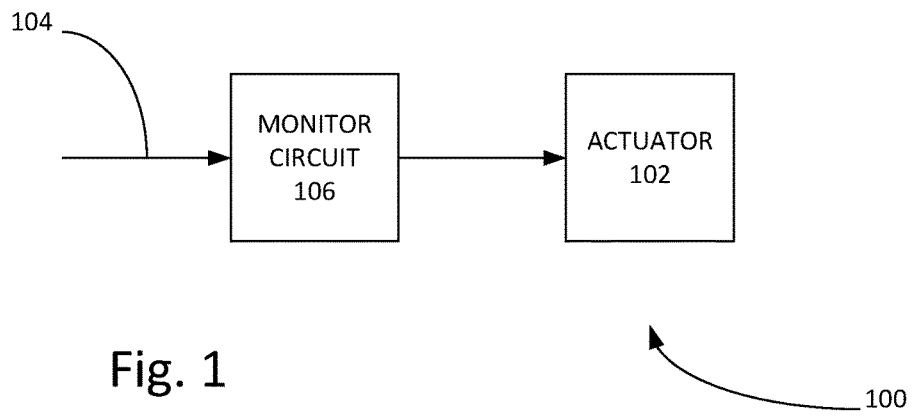
FIG. 1 is a block diagram illustrating an example integrated circuit, which can be used to drive a plurality of actuators.

An inkjet printing system, which is an example of a fluid ejection system, can include a printhead, a print substance supply, and an electronic controller. The printhead, which is an example of a fluidic actuator device or actuator device, can selectively pump fluid through fluid channels, or eject droplets of print substance through a plurality of nozzle assemblies, of which each nozzle assembly can be an example of an actuator, onto a medium during printing. Example nozzle assembly can include a resistor or piezoelement to pump the fluid through a nozzle or fluid channel. The nozzles of the nozzle assemblies can be arranged on the printhead in a column or an array and the electronic controller can selectively sequence ejection of print substance. The printhead can include hundreds or thousands of actuators, and each actuator ejects a droplet of print substance in a firing event in which electrical power and actuation signals are provided to printhead. In one example, a printhead can correspond with a color or print substance on the printing system. A printing system employing a subtractive color can include a printhead corresponding with a cyan print substance, a printhead corresponding with a magenta print substance, a printhead corresponding with a yellow print substance, and a printhead corresponding with a black, or key, print substance.

In order to eject a print substance from an actuator, the actuator can be loaded with the corresponding print substance and supplied with electrical power and actuation signals to select activation of the actuator. The firing event is triggered when a fire signal is applied to the loaded actuator to eject the print substance. The actuators are subjected to a sequence of firing events with a sequence of fire signals applied to the printhead as the printhead is moved relative the medium during printing. Each actuator can consume tens of milliamperes (mA) of current during a firing event. The printhead often staggers the firing events in each actuator and amongst actuators to reduce peak power consumption during printing. The amount of electrical power required to simultaneously fire all actuators on the printhead can exceed a current limit of the printing device, which can reduce print quality or cause substantial damage to the printhead.

This disclosure is directed to a circuit to reduce the likelihood of the printhead over-energizing the actuators, which could reduce print quality or cause substantial damage to the printhead. The circuit is configured to detect a possible over-energizing condition, such as if the fire signal is unexpectedly activated, or held in a high state, from a short circuit as a result of an errant print substance drop, metal flake, or another error on the printhead or in a circuit supplying the fire signal to the printhead. In one example, if the fire signal remains activated for longer than a selected amount of time, such as for longer than an expected amount of time to trigger a firing event, the circuit can disable the fire signal to the actuators and, in some examples, notify the electronic controller of the printing system of a fault condition in the printhead.

FIG. 1 illustrates an example integrated circuit 100 that can be included in a printhead system. The integrated circuit 100 includes an actuator 102 to eject a fluid, such as a print substance, in a firing event that is in response to a fire signal 104. In one example, the fire signal can be provided from an external source such as the electronic controller and received at the integrated circuit 100 at an electrical connection, such as a conductive contact pad. The integrated circuit also includes a monitor circuit 106, which is set by the fire signal 104. The fire signal 104 can be routed to the actuator 102 via the monitor circuit 106. The monitor circuit 106 blocks the fire signal 104 to the actuator 102 if the fire signal remains activated after a selected duration. For example, the monitor circuit 106 blocks the fire signal 104 from reaching the actuator 102 if the fire signal 104 remains activated for longer than the selected duration, such as longer than an expected amount of time to trigger the firing event. In one example, the monitor circuit 106 includes a timer that is started with an activated fire signal 104, such as when the fire signal is received at the monitor circuit 106. The fire signal 104 can be a logic signal having a selected voltage and current when activated, such as at a logic 1 setting, and deactivated, such as at a logic 0 setting. A plurality of fire signals can be received at the integrated circuit 100 as a stream of electrical pulses. If the fire signal 104 is deactivated before the timer expires at the selected duration, the monitor circuit 106 can be reset in anticipation of a subsequent fire signal. If the fire signal 104 remains active at the expiration of the timer at the selected duration, the monitor circuit 106 disables the fire signal 104 to the actuator 102. In one example, the monitor circuit 106 can including a blocking circuit to indicate a fault condition to an electronic controller if the monitor circuit 106 disables the fire signal, and disable the actuator 102 from subsequent firing events.

Figure 2:
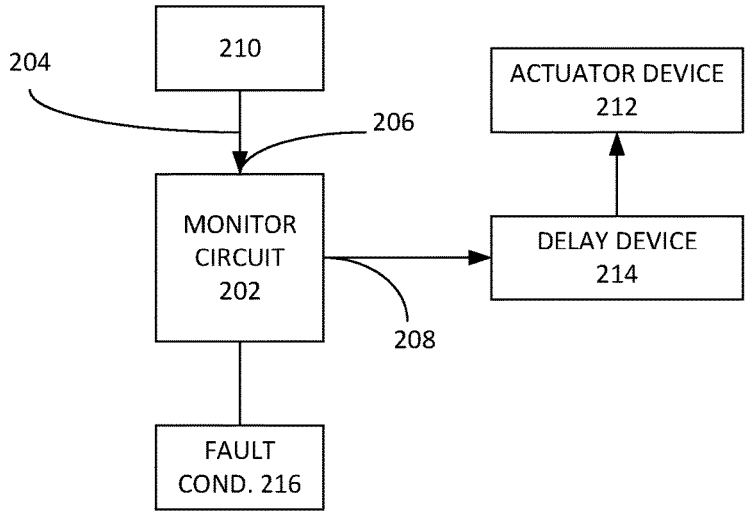
FIG. 2 is a block diagram illustrating an example fluid ejection device that can include the example integrated circuit of FIG. 1.

FIG. 2 illustrates an example of an integrated circuit 200 that can be incorporated into in a printhead and include features of the example integrated circuit 100. The integrated circuit 200 includes a monitor circuit 202 that can include a timer and a blocking circuit. The monitor circuit 202 can receive a fire signal 204 as an input 206 and selectively pass the fire signal 204 as an output 208. In one example, the integrated circuit is electrically coupled to a conductive electrical connection, such as a fire pad 210 to receive the fire signal from an external source, such as an electronic controller. In one example, the fire signal 204 is activated with a waveform having a logic voltage, such as a logic high voltage between about 1.8 volts and 15 volts, for a selected amount of time, such as one microsecond. The fire signal 204 can be deactivated with a logic voltage such as a logic low voltage of 0.0 volts or the reference voltage GND.

The integrated circuit 200 is configured to drive a plurality of fluid actuators on actuator device 212 to eject a plurality of print substance droplets. The integrated circuit 200 also includes a plurality of delay circuits on delay circuit device 214. Each of the delay circuits on delay circuit device 214 produces an output waveform similar to its input waveform but delayed by a selected amount of time. The plurality of delay circuits are coupled together in series on the delay circuit device 214. The delay circuit device 214 receives the fire signal 204 from the output 208 of the monitor circuit 202. Each of the of the delay circuits receives the fire signal 204 in series, and after a delay, provides the fire signal 204 via an output to a corresponding fluid actuator on the actuator device 212 trigger or actuate a firing event in the fluid actuators. For example, a delay circuit of the plurality of delay circuits is coupled in series to a successive delay circuit of the plurality of delay circuits. The delay circuit receives the fire signal 204, and after a local delay, provides the fire signal 204 to a corresponding fluid actuator of the plurality of fluid actuators and to the successive analog delay circuit. The successive delay circuit receives the fire signal 204, and, after a local delay provides the fire signal 204 to a corresponding fluid actuator of the plurality of fluid actuators. The delay circuits in the delay circuit device 214 can include digital circuits having flip-flops driven with a continuously running clock signal or analog delay elements receiving a bias current to affect the delay to stagger the firing events. The bias current can be used to finely adjust delay of the analog delay elements as well as adjust delay for various print speed modes of a printhead system.

In this example, the integrated circuit 200 staggers the firing events in the actuator device 212 from a single fire signal 204 to reduce peak power consumption in the actuator device 212 during printing. Rather than simultaneously actuate hundreds or thousands of actuators in the printhead, the delay circuit device 214 may simultaneously actuate a dozen or so actuators in the actuator device 212. In one example, firing events in the actuator device 212 are staggered in the order of 100 nanoseconds apart with a fire signal having a duration of approximately one microsecond. A fire signal 204 that is activated longer than the prescribed amount of time, such as a fire signal that has been held at the logic high as a result of a short circuit in the printhead system or the external source, can cause substantial damage to the printhead system.

The monitor circuit 202 includes a timer to meter the selected duration. The timer is started when a fire signal 204 is received, such as when the fire signal 204 is received at the input 206. If the monitor circuit 202 is activated, the fire signal 204 is passed to the delay circuit device 214. If the fire signal 204 is deactivated before the timer expires at the selected duration, the monitor circuit 202 can be reset in anticipation of a subsequent fire signal. If, however, the fire signal 204 remains active at the expiration of the timer at the selected duration, the monitor circuit 202 blocks the fire signal 204 from reaching the delay circuit device 214. Accordingly, the delay circuit device 214 is unable to provide the fire signal 204 to the actuator device 212 to trigger a firing event. The monitor circuit 202 also alerts a fault condition circuit 216, which can be detected by an electronic controller. In the example in which the duration of the fire signal 204 is one microsecond, the selected duration of the timer can be set to expire between 2.5 microseconds and 6.0 microseconds.

Figure 3:
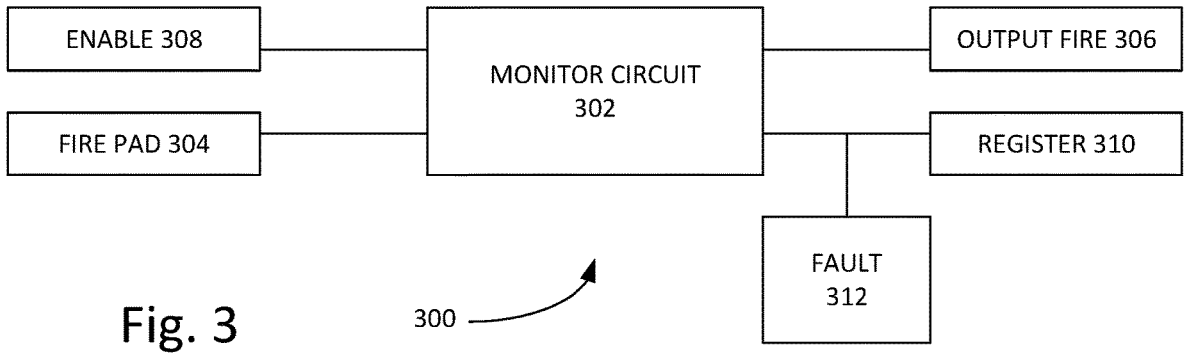
FIG. 3 is a block diagram illustrating an example monitoring circuit that can be included in the integrated circuit of FIG. 1.

FIG. 3 illustrates an example of an integrated circuit 300 that can be incorporated into in a printhead and include features of the example integrated circuit 100. The integrated circuit 300 includes a monitor circuit 302 that receives an input fire signal 304 and provides an output fire signal 306 to an actuator, such as via a delay element, to trigger a firing event to eject a fluid. The monitor circuit 302 includes a timer that is set by the fire signal to meter the selected duration and a blocking circuit to block the fire signal from output 306 after a selected duration. In the example, the monitor circuit 302 also receives an enable signal 308 that activates the monitor circuit 302. In one example, the monitor circuit will block the fire signal from the output in the absence, or deactivation, of the enable signal. In the example, the monitor circuit 302 can pass the fire signal from the input 304 to the output 306 regardless of the duration in the absence of the enable signal 308. In the example, the enable signal 308 operably dependent on a bit in a monitor circuit configuration register 310; and if the register 310 is set with a particular logic bit, such as 1, the integrated circuit 300 can provide the enable signal 308 to the monitor circuit 302 and allow the fire signal to pass through the monitor circuit 302 if the fire signal is of a duration less than the selected duration.

In the example, the monitor circuit 302, which is activated with the enable signal 308, receives the fire signal from the input 304. The received fired signal causes the voltage level at the input 304 to transition between logic levels, such as from logic low to logic high, which starts the timer to expire at a selected duration on the monitor circuit 302. If the fire signal transitions between logic levels, such as from logic high to logic low, before the timer expires, the timer can reset for the next firing event. If the fire signal has not transitioned before the timer expires, such as the fire signal remains at logic high, the blocking circuit prevents the fire signal from reaching the output 306.

In this example, the monitor circuit 302 indicates a fault condition with a fault condition signal at a fault output 312. The fault output 312 can be operably coupled to the electronic controller to provide the fault condition signal. In one example, upon receipt of the fault condition signal, the electronic controller can be configured to issue an error and stop the sending of subsequent fire signals to the integrated circuit 300. In addition, the fault condition can disable the integrated circuit 300 such as disable the actuator from ejecting fluid. For example, the fault output 312 can reset the monitor circuit configuration register 310. If the register 310 is reset with a particular logic bit according to the fault output 312, such as 0, the register 310 can deactivate the enable signal 308 and block subsequent fire signals at the monitor circuit 302 from reaching the output 306. In order to unblock the monitor circuit 302, in this example, the monitor circuit configuration register is again set with a logic bit, such as 1, to provide the enable signal 308.

In one example, the electronic controller, upon receiving a fault condition signal provided to the fault output 312, can also read the monitor circuit configuration register 310 to determine the nature of the fault condition. For instance, a printing system may include a plurality of integrated circuits, such as integrated circuit 300, that correspond with a plurality of printheads serviced by an electronic controller. Each of the plurality of integrated circuits may be coupled to a fault output. If the electronic controller receives a fault condition signal at the fault output, the electronic controller can read the monitor circuit configuration register of each of the plurality of integrated circuits to determine which of the plurality of integrated circuits blocked a fire signal with its monitor circuit.

In one example, the monitor circuit 302 can provide a pulldown signal as the fault condition signal to the fault output 312. The fault condition signal can be received an interpreted by electronic controller as the primary indication that a fault condition has occurred in the integrated circuit 300. In one example, the fault condition signal can be presented as a thermal fault. (The printhead includes thermal diode sensors operably coupled to the fault output 312 to generate a voltage that drops as the integrated circuit gets warmer, and the electronic controller can detect if that voltage falls below a threshold to indicate a thermal fault.) A low voltage fault condition signal at fault output 312 can be used to simulate a thermal fault, and the electronic controller can halt the printing process. Additionally, the electronic controller can poll the monitor circuit configuration register 310 of the integrated circuit 300, or, in the case of multiple printheads in the printing device, poll the monitor circuit configuration register on all of the integrated circuits, to determine the both the nature of the fault and the corresponding integrated circuit that generated the fault condition signal.

Figure 4:
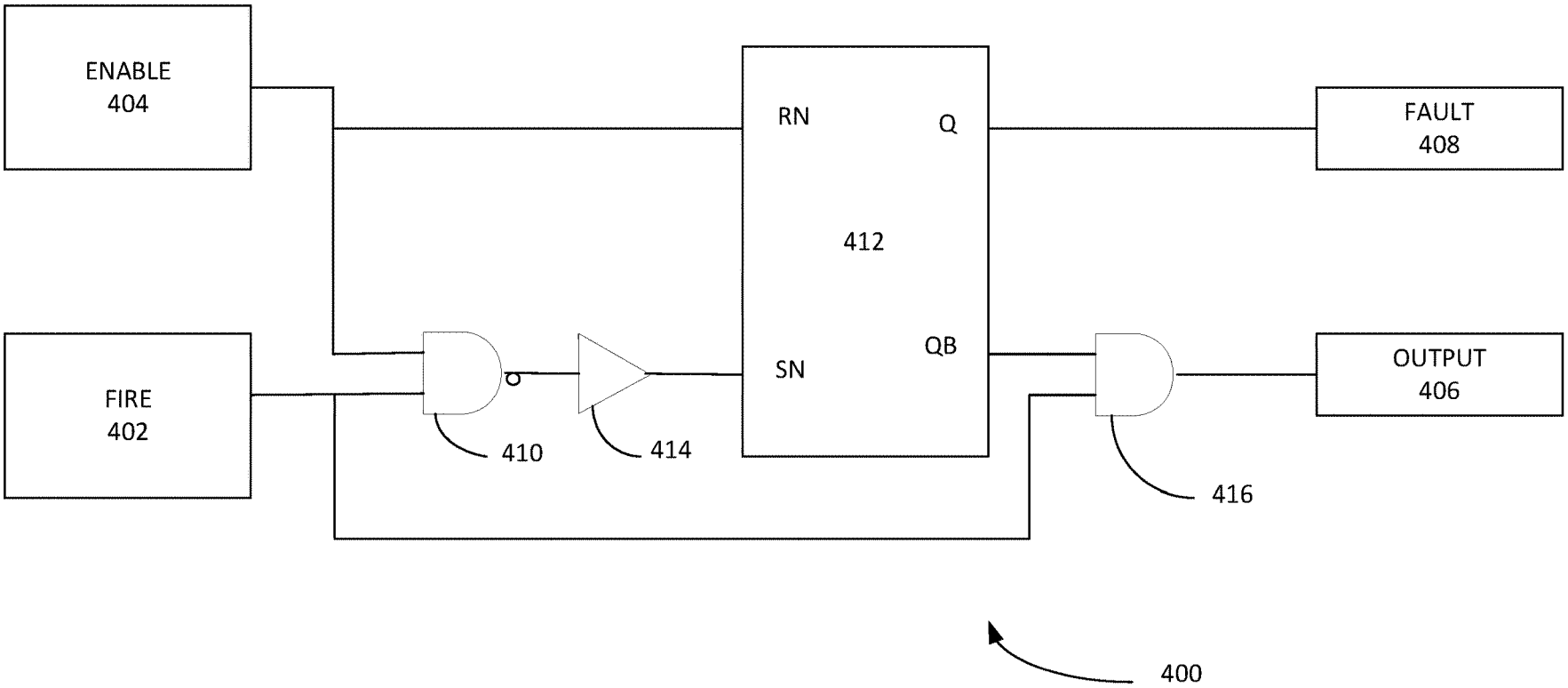
FIG. 4 is a schematic diagram illustrating an example monitoring circuit of the example monitoring circuit of FIG. 3.

FIG. 4 illustrates an example monitor circuit 400, which can be included monitor circuit 302 of integrated circuit 300. Monitor circuit 400 can be constructed out of integrated circuit elements that comprise logic elements such as gates, buffers, latches or flip flops. Example monitor circuit 400 is one example of a monitor circuit 302, and other configurations are contemplated. In the example, monitor circuit 400 receives a fire signal at fire input 402 and receives the enable signal at an enable input 404, and can output the fire signal at fire output 406 and output a fault condition signal at a fault output 408. In the example, the fire input 402 and enable input 404 are provided to the inputs of a NAND gate 410. The enable input 404 is also provided to the reset input RN of an SR NAND latch 412. The output of the NAND gate 410 is provided to a timer 414. The output of the timer 414 is provided to at set input SN of the latch 412. Latch 412 provides outputs Q and QB. Output Q can provide a fault condition signal to output 408. Output QB and fire input 402 can provided to AND gate 416, which provides an output to fire output 406. In this example, the timer 414 is configured to start with a signal from the NAND gate 410 and provide a signal to the set input SN of latch 412 after the selected duration, and the latch 412 and AND gate 416 operate as a blocking circuit 418 to block a fire signal from the fire output 406 if the fire signal is activated for longer than the selected duration as determined by the timer 414.

In one example, the timer 414 can include an analog circuit such as a resistor-capacitor circuit. The resistor-capacitor (RC) circuit can receive the output of the NAND gate 410 to a weak P transistor and a strong N transistor, which are operably coupled to an inverter circuit. In this example, the timer 414 operates as a delay buffer or an RC delay circuit. The output of the NAND gate 410 is provided as an output of the timer 414 after the selected duration. The selection of the circuit elements in the RC circuit can determine the length of delay of the signal input to the timer 414 to the output of the timer 414. In this configuration, the timer 414 delays transitions from logic high to logic low, i.e., falling voltage levels, for the selected duration, which can be on the order a few microseconds. Transitions from logic low to logic high, i.e., rising voltage levels, are quickly passed through the timer 414, on the order of a few nanoseconds.

Monitor circuit 400, including timer 414, are relatively simple designs to save on die area, but are also subject to large variations of timing from process, voltage levels, and temperature of the circuit. In one example, the selected duration can vary from 2.5 microseconds to 6.0 microseconds, or longer. But the actuators have been determined to sustain such durations of an activated fire signal.

In the example of the monitor circuit 400 with the timer 414 configured with an RC delay circuit, the enable input 404 is at logic high when the monitor circuit 400 is configured for normal operation. If the enable input 404 is at logic high, the reset input RN is also at logic high. A fire signal at the fire input 402 also provides a logic high to the NAND gate 410, and the input to the timer 414 is logic low. The delay of the timer 414 on transition from logic high to logic low is on the order of microseconds. If the fire signal at the fire input 402 is deactivated prior to the timer passing the logic low signal to the latch 412, the delay of the timer on transition from logic low to logic high is on the order of nanoseconds, so the signal to the set input SN of latch 412 remains logic high and the latch 412 is inactive. The output QB is at logic high and the fire signal passes through the AND gate 416 to fire output 406. If the fire signal at the fire input 402 is not deactivated prior to the timer 414 passing the logic low signal to the latch 412, the set input SN transitions from logic high to logic low, and the output QB becomes logic low. The fire signal does not pass through the AND gate 416 to fire output 406, and the fire signal is blocked in the monitor circuit 400. In the example, the output Q become logic high, and provides a logic high fault condition signal at fault output 408. In one example, the fault output 408 can be operably coupled to the set the monitor circuit configuration register 310 and the fault output 312 on integrated circuit 300 to indicate a failure status.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An integrated circuit, comprising:

an actuator to eject a fluid in response to a fire signal; and a monitor circuit coupled to the actuator to provide the fire signal in response to an enable signal based on a fault status, the enable signal to activate the monitor circuit, the monitor circuit including a timer and to be set by the fire signal to block the fire signal to the actuator after a selected duration in response to the timer receiving the fire signal and the enable signal or if the enable signal is deactivated from a fault condition in the fault status.

2. The integrated circuit of claim 1 wherein the monitor circuit includes an analog timer.

3. The integrated circuit of claim 2 wherein the analog timer includes a resistor-capacitor circuit.

4. The integrated circuit of claim 1 wherein the monitor circuit is configured to indicate a fault in response to blocking the fire signal.

5. The integrated circuit of claim 4 wherein the monitor circuit is configured to indicate the fault by one of setting a register corresponding with the monitor circuit and with a fault condition signal output from the integrated circuit.

6. The integrated circuit of claim 1 including a fire pad to receive the fire signal.

7. The integrated circuit of claim 6 wherein the monitor circuit is operably coupled to the fire pad to receive the fire signal.

8. The integrated circuit of claim 1 wherein the monitor circuit includes a timer that is started with the activated fire signal, and a blocking circuit operably coupled to the timer to block the fire signal from reaching the fluid actuator if the timer has expired and the fire signal is not deactivated.

9. The integrated circuit of claim 8 wherein the blocking circuit includes a latch and an AND gate.

10. The integrated circuit of claim 8 wherein the timer includes a buffer.

11. The integrated circuit of claim 10 wherein the buffer includes a resistor-capacitor circuit.

12. A printhead comprising an integrated circuit, the integrated circuit comprising:

an actuator to eject a print substance in response to a fire signal; and a monitor circuit coupled to the actuator to provide the fire signal in response to an enable signal based on a fault status, the enable signal to activate the monitor circuit, the monitor circuit including a timer and to be set by the fire signal to block the fire signal from reaching the actuator after a selected duration in response to the timer receiving the fire signal and the enable signal or if the enable signal is deactivated from a fault condition in the fault status.

13. The printhead of claim 12 wherein the monitor circuit is configured to indicate a fault of the integrated circuit in response to blocking the fire signal.

14. The printhead of claim 13 wherein the fault is indicated by setting a register corresponding with the monitor circuit.

15. The printhead of claim 13 where the fault is indicated with a fault condition signal output from the integrated circuit.

16. The print head of claim 12 wherein the monitor circuit includes a timer to meter the selected duration and a blocking circuit activated by the timer to block the fire signal from the actuator.

17. An integrated circuit, comprising:

a fluid actuator to eject a print substance in response to an activated fire signal;

a timer that is started with the activated fire signal and an enable signal based on a fault status; and a blocking circuit operably coupled to the timer and to receive the fire signal and the enable signal, the blocking circuit to block the fire signal to the fluid actuator if the timer has expired and the fire signal is not deactivated or if the enable signal is deactivated from a fault condition in the fault status.

18. The integrated circuit of claim 17 wherein the blocking circuit includes a latch and an AND gate.

19. The integrated circuit of claim 17 wherein the timer includes a buffer.

20. The integrated circuit of claim 19 wherein the buffer includes a resistor-capacitor circuit.

* * * * *